US010907896B2

(12) United States Patent
Vist et al.

(10) Patent No.: US 10,907,896 B2
(45) Date of Patent: Feb. 2, 2021

(54) METHOD FOR TURNDOWN OF A LIQUEFIED NATURAL GAS (LNG) PLANT

(75) Inventors: Sivert Vist, Hundhamaren (NO); Tore Løland, Stavanger (NO); Morten Svenning, Hammerfest (NO); Silja Eriksson Gylseth, Oslo (NO)

(73) Assignee: EQUINOR ENERGY AS, Stavanger (NO)

( * ) Notice: Subject to any disclaimer, the term of this patent is extended or adjusted under 35 U.S.C. 154(b) by 931 days.

(21) Appl. No.: 13/580,977

(22) PCT Filed: Feb. 25, 2011

(86) PCT No.: PCT/EP2011/052842

§ 371 (c)(1),
(2), (4) Date: Nov. 6, 2012

(87) PCT Pub. No.: WO2011/104359

PCT Pub. Date: Sep. 1, 2011

(65) Prior Publication Data

US 2013/0042645 A1 Feb. 21, 2013

(30) Foreign Application Priority Data

Feb. 26, 2010 (NO) ..... 20100285

(51) Int. Cl.
*F25J 1/02* (2006.01)
*F25J 1/00* (2006.01)

(52) U.S. Cl.
CPC ..... *F25J 1/0022* (2013.01); *F25J 1/0245* (2013.01); *F25J 1/0247* (2013.01); *F25J 1/0248* (2013.01);
(Continued)

(58) Field of Classification Search
CPC ..... F25J 1/0245; F25J 1/0247; F25J 1/0248; F25J 1/0022; F25J 2245/02; F25J 2210/062; F25J 2210/62
(Continued)

(56) References Cited

U.S. PATENT DOCUMENTS 4,147,525 A 4/1979 Bradley
4,675,037 A * 6/1987 Newton ..... F17C 13/02 62/48.2
(Continued)

FOREIGN PATENT DOCUMENTS

DE 10 2004 028 052 A1 12/2005
EP 1253388 A1 10/2002
(Continued)

OTHER PUBLICATIONS

WO2010015764A2 Translation.*

*Primary Examiner* — Brian M King
(74) *Attorney, Agent, or Firm* — Birch, Stewart, Kolasch & Birch, LLP

(57) ABSTRACT

A method for turndown of a liquefied natural gas (LNG) plant, the plant including a liquefaction unit arranged in a flow path of the plant, includes removing LNG from a first location in the flow path downstream of the liquefaction unit; vaporizing the removed LNG, or heating the removed LNG so that the removed LNG is transformed to gas phase; and re-admitting the vaporized or transformed LNG to the flow path at a second location upstream of the liquefaction unit. A corresponding LNG plant is also provided.

3 Claims, 3 Drawing Sheets

(52) U.S. Cl.
CPC ..... *F25J 2210/04* (2013.01); *F25J 2210/62* (2013.01); *F25J 2220/62* (2013.01); *F25J 2245/02* (2013.01)

(58) Field of Classification Search
USPC ..... 62/606
See application file for complete search history.

(56) References Cited

U.S. PATENT DOCUMENTS

| | | | | |
|---|---|---|---|---|
| 6,085,545 | A | 7/2000 | Johnston | |
| 2003/0177785 | A1* | 9/2003 | Kimble | F25J 1/0022 62/613 |
| 2007/0107465 | A1* | 5/2007 | Turner | F25J 1/0022 62/613 |
| 2009/0282865 | A1* | 11/2009 | Martinez | F25J 3/0209 62/620 |
| 2010/0011663 | A1* | 1/2010 | Coyle | F25J 1/0022 48/127.3 |
| 2011/0056238 | A1 | 3/2011 | Mak | |

FOREIGN PATENT DOCUMENTS

| | | | |
|---|---|---|---|
| EP | 1895254 | A1 | 3/2008 |
| NO | 20052658 | A | 12/2005 |
| WO | WO 2008/025741 | A2 | 3/2008 |
| WO | WO 2010015764 | A2 * | 2/2010 |

* cited by examiner

METHOD FOR TURNDOWN OF A LIQUEFIED NATURAL GAS (LNG) PLANT

The present invention is related to a method for turndown of a liquefied natural gas (LNG) plant, and a corresponding LNG plant.

When a liquefied natural gas (LNG) plant is warm (e.g. at ambient temperature), after a production stop, the plant has to be cooled gradually to prevent thermal stresses in heat exchangers used to cool the natural gas down to about −160° C. This process may typically take from several hours up to about 1-2 days, and is carried out by circulating a refrigerant or cooling medium in gas phase through the cooling circuits of the heat exchangers. For cooling down the all the relevant components and for having a heat sink for the refrigerant, a flow or stream of natural gas is also provided through the plant, typically about 1-5% of the full production rate.

However, the flow rate of natural gas at the inlet of the plant may sometimes not be lowered to just any rate. This means that the minimum flow rate of natural gas may be higher than the desired rate. This means in turn that excess gas has to be flared before it reaches the liquefaction unit with the heat exchangers. The excess gas is typically flared upstream of the liquefaction unit of the plant. If for example the natural gas flow rate at the inlet is 30% of full production rate, 25% has to be flared. Hence, natural gas is wasted, and emissions are increased.

Further, for floating LNG plants or LNG plants built in arctic areas, LNG ship regularity may be low. Hence, loading of LNG from LNG storage tanks to ships cannot always be performed when wanted, and there is a risk that the storage tanks are filled up. Also, the supply of natural gas to the plant may be interrupted, or there may be an internal interruption in the plant, for instance in the $CO_2$ removal unit. All these situations may be remedied by shutting down and later re-starting the plant. However, shutting down and re-starting the plant is time-consuming, costly, and increases the stress loads on equipment in the plant.

It is an object of the present invention to provide an improved method and LNG plant, which may at least partly overcome the above mentioned problems.

This, and other objects that will be apparent from the following description, is achieved by the method and LNG plant according to the appended independent claims. Embodiments are set forth in the dependent claims.

According to an aspect of the present invention, there is provided a method for turndown of an LNG plant, the plant including a liquefaction unit arranged in a (main) flow path of the plant, wherein the method comprises: removing LNG from a first location in the flow path downstream of the liquefaction unit; vaporizing the removed LNG, or heating the removed LNG so that the removed LNG is transformed to gas phase; and re-admitting the vaporized or transformed LNG to the flow path at a second location upstream of the liquefaction unit.

By re-circulating LNG at turndown instead of shutting the plant off, a more efficient operation of the plant is achieved. In particular, time for re-start of the plant is saved (usually about 24 hours), and wear of the plant during shut-down and re-start is avoided.

The present method may further comprise increasing the pressure of the removed LNG, for instance by pumping the removed LNG to a pressure of about 5-10 MPa before vaporizing or transforming the removed LNG. The removed LNG may alternatively first be vaporised and then compressed in a compressor to the inlet pressure of the plant, but this alternative requires more energy and is hence more costly.

Further, the vaporized or transformed LNG may be re-admitted or returned at a rate less than the plant's full production rate.

During start-up of the plant, the LNG may be removed from an LNG storage tank of the plant, or from a rundown line to the storage tank of the plant. Further, the vaporized or transformed LNG may be re-admitted to the flow path upstream of a pre-cooling unit of the plant, but downstream of (another) gas pre-treatment unit of the plant. The gas pre-treatment unit may for instance be a drying and mercury removal unit or a $CO_2$ removal unit. The vaporized or transformed LNG could also be readmitted upstream of the gas pre-treatment units. The vaporized or transformed LNG is here re-admitted at a rate that corresponds to about 1-10% of the plant's full production rate. Here, the re-admitted vaporized or transformed LNG is used as a heat sink (heat absorbing fluid) for heat exchangers in the liquefaction unit. By re-circulating LNG instead of using natural gas directly from the inlet of the plant at start-up, no flaring is necessary. Hence, emissions related to flaring are reduced or removed.

In one or more embodiments of the present invention, during turndown of the plant, the LNG may be removed from at least one of: a line between the liquefaction unit and an end flash or $N_2$ stripping unit of the plant; the end flash or $N_2$ stripping unit of the plant; an LNG storage tank of the plant; and a rundown line to the storage tank of the plant. LNG removed from the line between the liquefaction unit and an end flash or $N_2$ stripping unit has usually not been depressurized, and hence less energy is needed to pump the removed LNG up to a desired pressure. In the end flash or $N_2$ stripping unit and in the LNG storage tank, the LNG is usually at/depressurized to ambient pressure. Further, the vaporized or transformed LNG may be re-admitted to the flow path between an inlet and a gas pre-treatment unit of the plant. The gas pre-treatment unit may be a $CO_2$ removal unit, but could also be a drying and mercury removal unit or a pre-cooling unit. The vaporized or transformed LNG is here re-admitted at a rate that corresponds to about 30% of the plant's full production rate, or at a rate equal to the turndown rate of the plant. The turndown rate of the plant is the lowest possible stable production rate.

According to another aspect of the present invention, there is provided a liquefied natural gas (LNG) plant, comprising: a liquefaction unit arranged in a flow path of the plant; first means for removing LNG from a first location in the flow path downstream of the liquefaction unit; one of a vaporizer adapted to vaporize the removed LNG and a heater adapted to heat the removed LNG so that the removed LNG is transformed to gas phase; and second means for re-admitting the vaporized or transformed LNG to the flow path at a second location upstream of the liquefaction unit. This aspect may exhibit similar features and technical effects as the previously discussed aspect of the invention. The LNG plant may further comprise control means adapted or configured to control at least one of said first means, the vaporizer or heater, and the second means during turndown of the LNG plant.

These and other aspects of the present invention will now be described in more detail, with reference to the appended drawings showing currently preferred embodiments of the invention.

Figure 1:
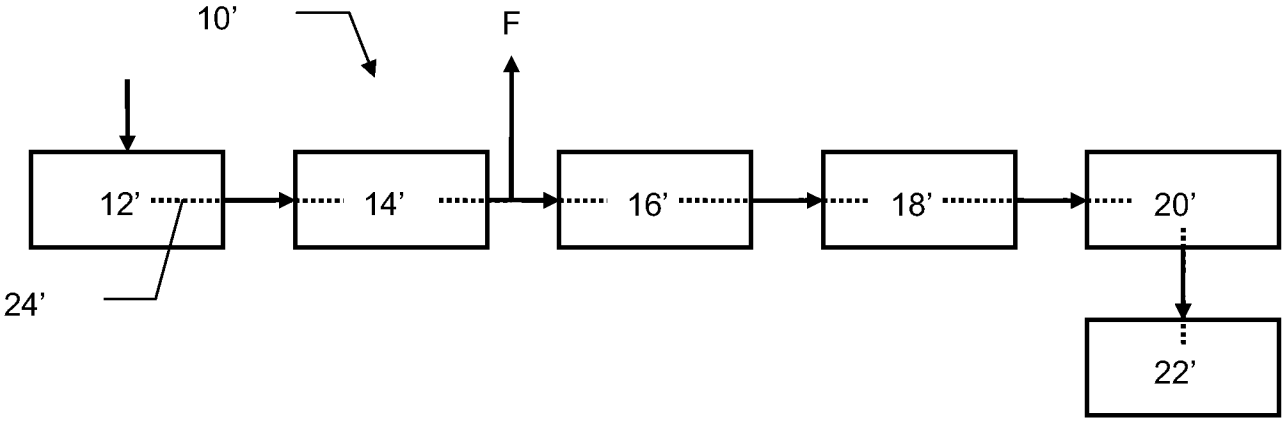
Fig. 1 (prior art)
FIG. 1 is a block diagram of an LNG plant according to prior art.

FIG. 1 is block diagram of an LNG plant 10' according to prior art. The plant 10' comprises, in sequence: an inlet 12' for receiving natural gas, a $CO_2$-removal unit 14', a drying and mercury-removal unit 16', a pre-cooling or refrigeration unit 18', a liquefaction unit 20', and an LNG storage tank 22'. A main flow line 24' runs from the inlet 12' to the LNG storage tank 22. The general operation of such an LNG plant is known to the person skilled in the art, and will not be explained in further detail here.

In a prior art start-up procedure, natural gas is flared downstream of the $CO_2$-removal unit 14', as illustrated in FIG. 1 by reference F. Flaring of natural gas, however, causes losses of natural gas and unwanted emissions.

Figure 2:
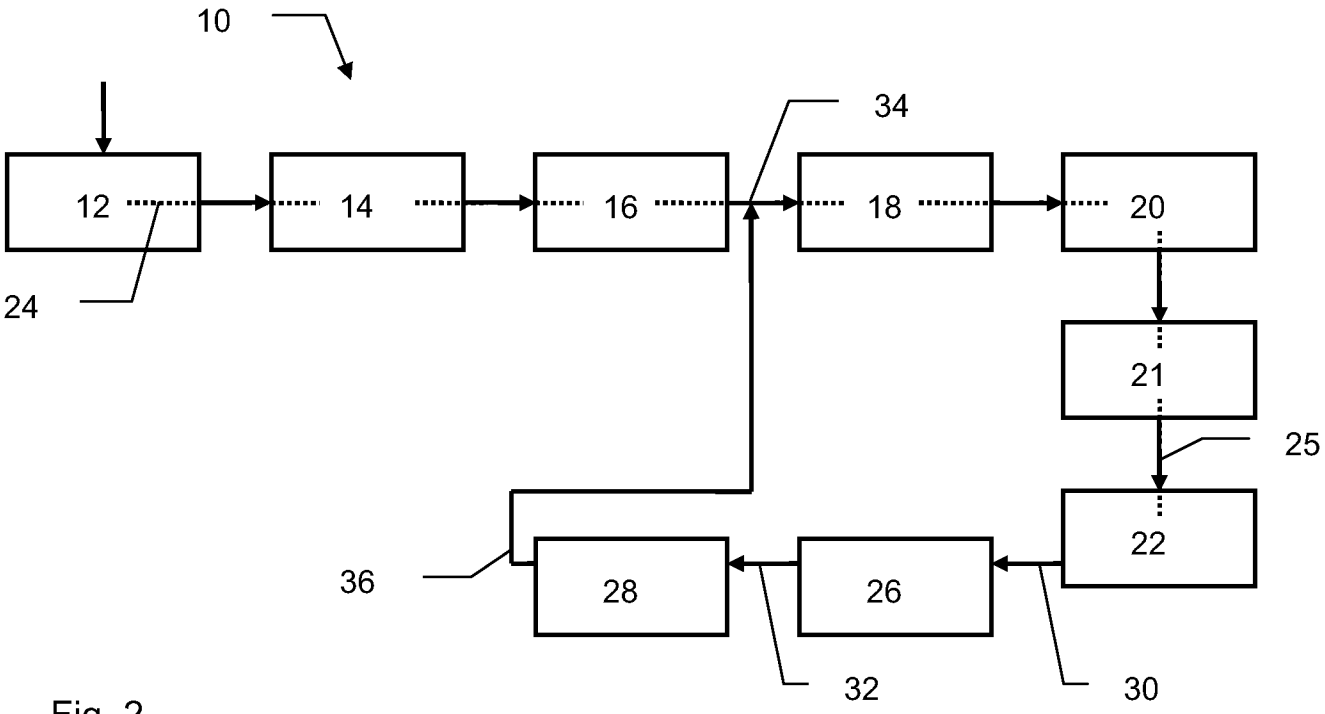
FIG. 2 is a block diagram of an LNG plant according to an embodiment of the present invention.

FIG. 2 is a block diagram of an LNG plant 10 according to an embodiment of the present invention. The LNG plant 10 in FIG. 2 comprises, in sequence: an inlet 12 for receiving natural gas, a $CO_2$-removal unit 14, a drying and mercury-removal unit 16, a pre-cooling or refrigeration unit 18, a liquefaction unit 20, an end flash or $N_2$ stripping unit 21, and an LNG storage tank 22. A main flow line or path 24 runs from the inlet 12, through the various units 14-21, and to the LNG storage tank 22. A rundown line to the LNG storage tank 22 is designated 25.

In addition, the plant 10 comprises an LNG pump 26 and an LNG vaporizer 28. The LNG pump 26 is in fluid communication with the LNG storage tank 22 via line 30, and with the LNG vaporizer 28 via line 32. Further, the LNG vaporizer 28 is in fluid communication with the main flow line 24 at a location 34 between the last of the gas pre-treatment unit 14-16, namely the drying and mercury-removal unit 16, and the pre-cooling unit 18 via line 36. The LNG pump 26 is adapted to pump LNG removed from the LNG tank 22 via line 30 to a pressure of about 5-10 MPa. The vaporizer 28 is adapted to vaporize the removed (and pressurized) LNG, by heating below the critical pressure of LNG. Said lines may for example be pipes, piping, or the like.

During start-up of the plant 10, i.e. when the temperature of heat exchangers in the liquefaction unit 18 is above a production temperature (they may for instance be at ambient temperature) following e.g. a production stop, the ordinary gas flow at the inlet 12 is shut off, and LNG may be removed or extracted from the LNG storage tank 22 and provided to the LNG pump 26 by means of line 30. The removed LNG is then pumped to a pressure of about 5-10 MPa by means of the LNG pump 26. The pressurized LNG is then supplied via line 32 to the LNG vaporizer 28 where it is vaporized and hence is transformed to gas phase. Thereafter, the vaporized LNG is fed or readmitted or otherwise returned into the main flow path 24 via line 36.

The re-admitted vaporized LNG is then transported or re-circulated in the main flow path 24 through the liquefaction unit 20 for cooling heat exchangers (not shown) in the liquefaction unit 20. The re-circulating natural gas acts as a heat sink for a refrigerant of the heat exchangers, and is hence not directly used as a refrigerant in the heat exchangers.

The method according to this embodiment is carried on until the heat exchangers reach a production temperature, typically from about −35° C. in the pre-cooling unit 18 down to below −100° C. in the liquefaction unit 20, and then the regular production process follows.

The LNG pump 26, the LNG vaporizer 28, and the lines 30, 32, 36 in FIG. 2 are dimensioned and/or controlled such that the vaporized LNG is re-admitted at a rate that corresponds to about 1-10%, or specifically 1-5%, of the full or regular production rate of the plant 10. Such control may be performed by a control means (not shown) of the plant 10.

Figure 3:
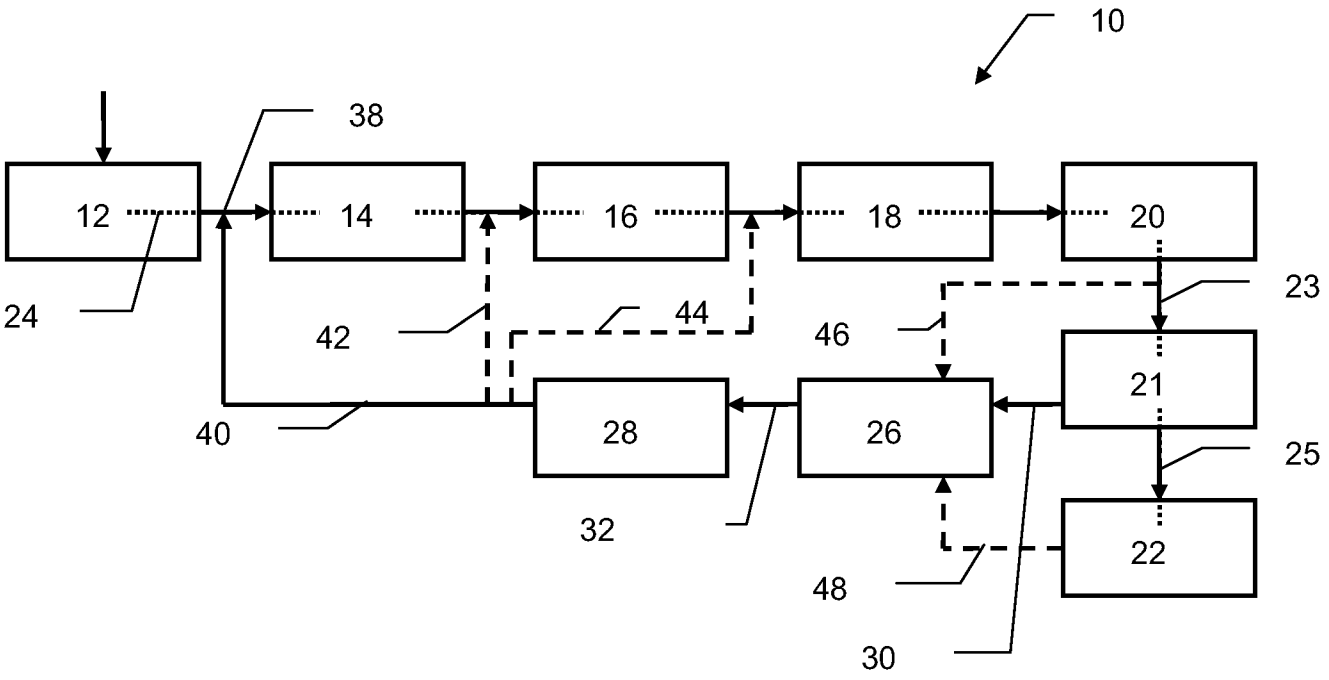
FIG. 3 is a block diagram of an LNG plant according to another embodiment of the present invention.

FIG. 3 is a block diagram of an LNG plant 10 according to another embodiment of the present invention. The LNG plant 10 in FIG. 3 comprises, in sequence: an inlet 12 for receiving natural gas, a $CO_2$-removal unit 14, a drying and mercury-removal unit 16, a pre-cooling or refrigeration unit 18, a liquefaction unit 20, an end flash or $N_2$ stripping unit 21, and an LNG storage tank 22. A main flow line or path 24 runs from the inlet 12, through the various units 14-21, and to the LNG storage tank 22. The line between the liquefaction unit 20 and the end flash or $N_2$ stripping unit 21 is designated 23, and a rundown line to the LNG storage tank 22 is designated 25.

In addition, the plant 10 comprises an LNG pump 26 and an LNG vaporizer 28. The LNG pump 26 is in fluid communication with the end flash or $N_2$ stripping unit 21 via line 30, and with the LNG vaporizer 28 via line 32. Further, the LNG vaporizer 28 is in fluid communication with the main flow line 24 at a location 38 between the inlet 12 and the first gas pre-treatment unit, namely the $CO_2$-removal unit 14, via line 40. The LNG pump 26 is adapted to pump LNG removed from the LNG tank 22 via line 30 to a pressure of about 5-10 MPa. The vaporizer 28 is adapted to vaporize the removed (and pressurized) LNG, below the critical pressure of LNG. Said lines may for example be pipes, piping, or the like.

During turndown of the plant 10, e.g. when the LNG tank 22 is full or when there is an interruption or significant decrease in supply of natural gas through the inlet 12, the ordinary gas flow at the inlet 12 is purposely or unintentionally shut off, and LNG is removed or extracted from the end flash or $N_2$ stripping unit 21 and supplied to the LNG pump 26 by means of line 30. The removed LNG is then pumped to a pressure of about 5-10 MPa by means of the LNG pump 26. The pressurized LNG is then supplied via line 32 to the LNG vaporizer 28 where it is vaporized and hence is transformed to gas phase. Thereafter, the vaporized LNG is fed or readmitted or otherwise returned into the main flow path 24 via line 40.

The re-admitted vaporized LNG is then transported or re-circulated in the main flow path 24 to keep the plant 10 operating at a reduced rate. The LNG pump 26, the LNG vaporizer 28, and the lines 30, 32, 40 in FIG. 3 are dimensioned and/or controlled such that the vaporized LNG is re-admitted at a rate that corresponds to about 30% of the full or normal production rate of the plant 10, or at a rate equal to the turndown rate of the plant 10. Such control may be performed by the above-mentioned control means.

The method according to this embodiment is carried on until the LNG can be loaded from the storage tank 22 as usual, or the supply of natural gas at the inlet 12 is recommenced, for instance, and full production in the plant 10 can resume.

Optionally, lines 42 and 44 may be provided to supply vaporized LNG also at other locations. Vaporized LNG may for instance be supplied via line 42 in case the $CO_2$-removal unit 14 is malfunctioning, or via line 44 in case the drying and mercury-removal unit 16 is out of order. Further, the LNG may alternatively be taken from line 23 between the liquefaction unit 20 and the end flash or $N_2$ stripping unit 21 via line 46, or from the LNG storage tank 22 via line 48. The optional and alternative lines are illustrated with dashed lines in FIG. 3, and said lines may for example be appropriate pipes, piping, or the like.

The LNG plant 10 according to the present invention typically has a minimum capacity of 1 MTPA (million metric tonnes per annum). However, the present invention could also be applied to plants having a capacity down to 0.1 MPTA, for example.

The person skilled in the art will realize that the present invention by no means is limited to the embodiments described above. On the contrary, many modifications and variations are possible within the scope of the appended claims.

For instance, instead of vaporizing the removed LNG, the removed LNG can be heated, typically above its critical pressure, such that the LNG changes or transitions to gas phase. In such a case, the vaporizer 28 may be replaced by a heater adapted to heat the removed LNG so that the removed LNG is transformed to gas phase.

The invention claimed is:

1. A method for operation of a liquefied natural gas (LNG) plant, wherein the plant comprises:

an inlet for receiving natural gas;

a $CO_2$ removal unit;

a drying and mercury-removal unit;

a pre-cooling or refrigeration unit;

a liquefaction unit;

an end flash or $N_2$ stripping unit; and an LNG storage tank;

wherein natural gas enters at the inlet, flows along a flow path through the $CO_2$ removal unit, the drying and mercury-removal unit, the pre-cooling or refrigeration unit, the liquefaction unit and end flash or $N_2$ stripping unit in turn and is stored as liquefied natural gas in the LNG storage tank and is stored as liquefied natural gas in the storage tank;

the plant further comprising an LNG pump connected to the end flash or $N_2$ stripping unit; and an LNG vaporizer connected to the LNG pump;

the method comprising the steps of:

removing LNG from the end flash or $N_2$ stripping unit;

passing the removed LNG through the LNG pump, to pump the removed LNG to a pressure of about 5-10 MPa;

passing the pressurized LNG to the LNG vaporizer to vaporize the pressurized LNG so that the pressurized LNG is transformed to gas phase; and re-admitting the vaporized LNG to the flow path at a point downstream of the inlet and upstream of the liquefaction unit; and wherein the method is carried out during turndown of the LNG plant, when the LNG storage tank is full or when there is an interruption in supply of natural gas through the inlet, and the method is carried on until the LNG can be loaded from the LNG storage tank, or the supply of natural gas at the inlet is recommenced.

2. The method according to claim 1, wherein the vaporized LNG is re-admitted at a rate less than the plant's full production rate.

3. The method according to claim 2, wherein the vaporized LNG is re-admitted at a rate that corresponds to about 30% of the plant's full production rate or the turndown rate of the plant.

* * * * *